US007328875B2

(12) United States Patent
Kastner et al.

(10) Patent No.: US 7,328,875 B2
(45) Date of Patent: Feb. 12, 2008

(54) ADJUSTABLE-HEIGHT CHAIR COLUMN

(75) Inventors: Helmut Kastner, Neukirchen (DE); Gerhard Wunderling, Pegnitz (DE)

(73) Assignee: Suspa Holding GmbH, Altdorf (DE)

( * ) Notice: Subject to any disclaimer, the term of this patent is extended or adjusted under 35 U.S.C. 154(b) by 354 days.

(21) Appl. No.: 11/028,607

(22) Filed: Jan. 5, 2005

(65) Prior Publication Data

US 2005/0161559 A1 Jul. 28, 2005

(30) Foreign Application Priority Data

Jan. 24, 2004 (DE) ..... 10 2004 003 624

(51) Int. Cl.
*F16M 13/00* (2006.01)

(52) U.S. Cl. ..... 248/161; 248/404

(58) Field of Classification Search ..... 248/161, 248/188.5, 404; 297/344.19
See application file for complete search history.

(56) References Cited

U.S. PATENT DOCUMENTS 4,601,454 A 7/1986 Mattsson et al.
4,756,496 A * 7/1988 Hosan et al. ..... 248/161
5,031,869 A * 7/1991 Strater et al. ..... 248/406.1
5,443,573 A * 8/1995 Thiele et al. ..... 267/64.12
5,531,413 A 7/1996 Wolf et al.
5,944,290 A 8/1999 Fuhrman et al.
5,988,754 A * 11/1999 Lamart et al. ..... 297/423.38

FOREIGN PATENT DOCUMENTS

DE 18 12 282 C3 6/1970
DE 1 931 021 1/1971
DE 44 28 259 C2 2/1996
GB 2 083 349 A 3/1982

* cited by examiner

*Primary Examiner*—Korie Chan
(74) *Attorney, Agent, or Firm*—Browdy and Neimark, PLLC

(57) ABSTRACT

An adjustable-height chair column comprises an upright tube and a gas spring, the piston rod of which is fixed in the upright tube, and the housing of which is displaceably guided in the upright tube. A safeguard against rotation is provided which, in the extended position, locks the housing and the upright tube against rotation.

12 Claims, 3 Drawing Sheets

ADJUSTABLE-HEIGHT CHAIR COLUMN

BACKGROUND OF THE INVENTION

1. Field of the Invention

The invention relates to an adjustable-height chair column.

2. Background Art

Chair columns of the generic type are generally known. They comprise an adjustable-length gas spring, the housing of which is displaceably guided in an upright tube. The upright tube is fixed to a pedestal, while the housing of the gas spring is guided in the upright tube, as a rule in a guide bush provided in the upright tube. If chairs that are equipped in this way have folding seats, several chairs can be moved one into the other with the chair columns then having a comparatively small distance from each other. This can be helpful in the space-saving storage of chairs or also in moving a whole group of chairs from one place to another. It is then desirable that the chairs take, and keep, a defined position relative to each other.

SUMMARY OF THE INVENTION

It is an object of the invention to embody an adjustable-height chair column in such a way that the upright tube and the housing of the gas spring are able to take a position of a defined angle of rotation relative to each other and that they maintain this position.

According to the invention, this object is attained in an adjustable-height column, comprising an upright tube which has a central longitudinal axis; a gas spring which is disposed in the upright tube coaxially of the central longitudinal axis, having a housing which is displaceable inside the upright tube in the direction of the central longitudinal axis into an extended position and a piston rod which is fixed in the upright tube; and a safeguard against rotation which, in the extended position, locks the housing and the upright tube against rotation. The design according to the invention ensures that, upon complete extension of the housing of the gas spring from the upright tube, the housing and the upright tube are arrested one relative to the other at least substantially non-rotatably, taking a fixed position of rotation one relative to the other. This locking effect can be non-positively; however, positive fit is of special advantage because it is more reliable. Even an assembly by positive fit can be designed in such a way that it will disengage when a given turning moment is exceeded. A favourable embodiment of this is implemented by the safeguard against rotation comprising a locking element which is joined to the housing, and a locking abutment which is joined to the upright tube.

A particularly simple embodiment resides in the locking element and the locking abutment comprising at least one cutout and at lest one locking rib which allocated and adapted thereto. A particularly simple way of how to produce a positive-fit safeguard against rotation is put into practice when the at least one cutout and the at least one locking rib have matching inclined surfaces of an aperture angle b. Disengagement upon overload is accomplished by each cutout and each locking rib having matching inclined surfaces, and by $5° \leqq b \leqq 25°$, and preferably $10° \leqq b \leqq 15°$, applying to the aperture angle b. Seating free from play in the direction of rotation is obtained by all the inclined surfaces being close to each other in the extended position, in which a clearance exists between the bottom of a cutout and the locking rib that engages with the cutout.

With solely one adapted cutout being allocated to each locking rib, this helps accomplish that the safeguard against rotation becomes effective only in a certain given position of interengagement of the locking element and the locking abutment.

Further advantages, features and details of the invention will become apparent from the ensuing description of an exemplary embodiment, taken in conjunction with the drawing.

DESCRIPTION OF A PREFERRED EMBODIMENT

Figure 1:
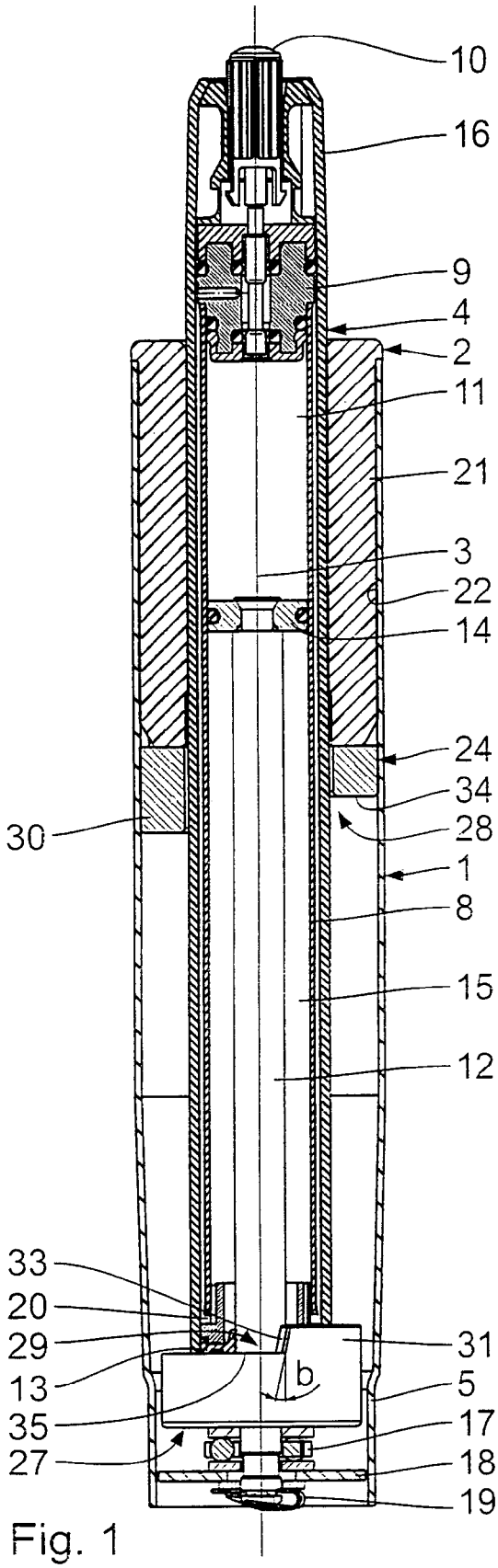
FIG. 1 is a longitudinal sectional view of a chair column in a contracted condition.
Figure 2:
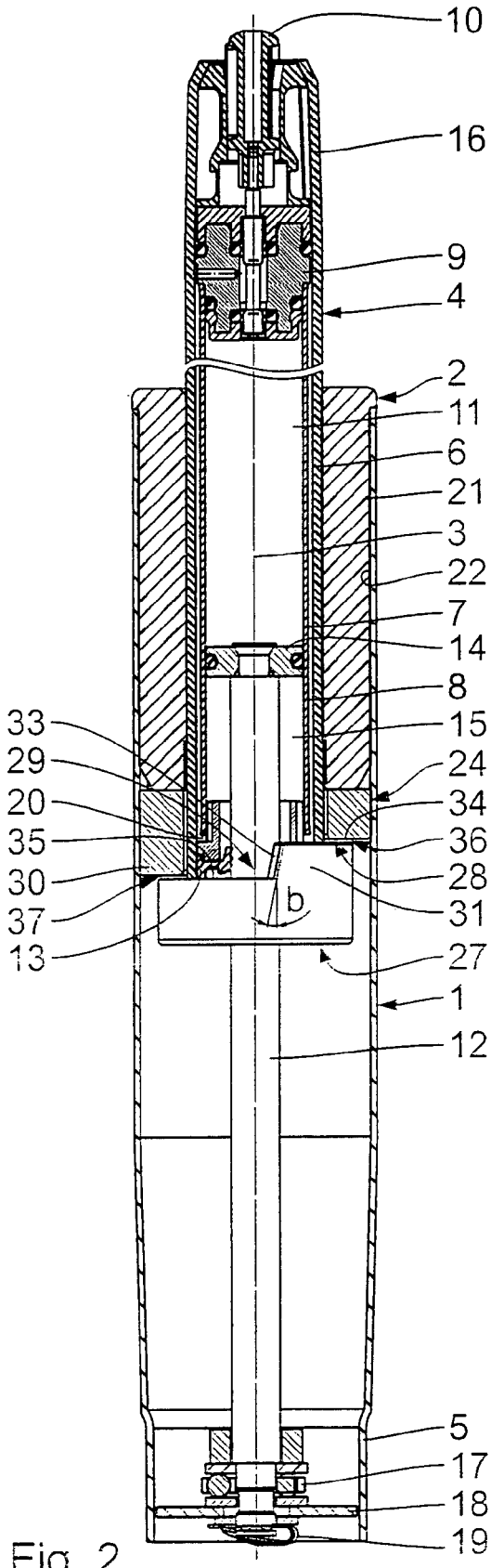
FIG. 2 is a view of the chair column according to FIG. 1 in a completely extended condition.
Figure 3:
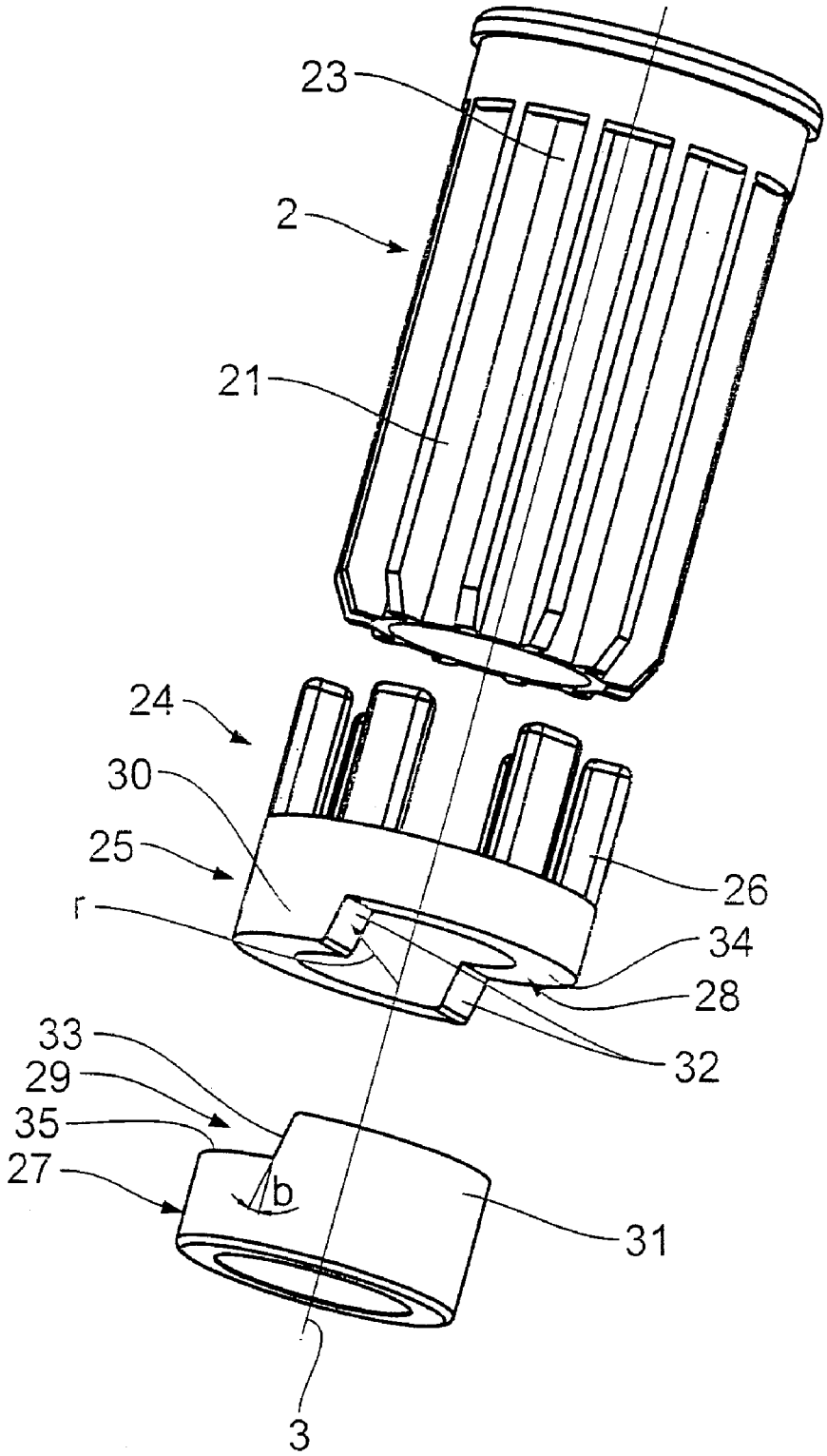
FIG. 3 is a perspective exploded view of the safeguard against rotation of the chair column.

The chair column seen in the drawing comprises an upright tube 1 and an adjustable-length gas spring 4 which is guided therein by means of a guide bush 2 for displacement in the direction of a common central longitudinal axis 3. The bottom end of the upright tube 1 is provided with a holding cone 5 for attachment to a conventional chair pedestal.

The gas spring 4 has a substantially cylindrical housing 6 which is guided in the guide bush 2. An internal tube 7 is disposed in the housing 6 concentrically of the axis 3, with a ring channel 8 being provided between the internal tube 7 and the housing 6. A valve 9 is disposed in the housing 6 at the top end thereof that is outside the upright tube 1; the valve 9 is operable by means of an operating pin 10 that projects from the housing 6. It serves for optionally connecting the ring channel 8 to the first sectional housing chamber 11 that is formed inside the internal tube 7 in vicinity to the valve 9.

A piston rod 12 is disposed in the internal tube 7 concentrically of the axis 3 and for displacement in the direction thereof; it is extended out of the bottom end of the housing 6 that is opposite the valve 9 inside the upright tube 1. A guide and seal unit 13 serves for gas-tight guidance of the piston rod 12 in this area. A piston 14 is mounted on the end, inside the internal tube 7, of the piston rod 12; it is guided on, and sealed towards the internal tube 7, dividing the first sectional housing chamber 11 from a second sectional housing chamber 15 that is formed between the piston 14 and the guide and seal unit 13. A fastening section 16 that tapers conically is formed on the housing 6 at the end thereof in vicinity to the valve 9; by means of the fastening section 16 the gas spring 4 is mountable on a corresponding receptacle on the bottom side of a seat, for example a seat support. At its bottom end, outside the housing 6, the piston rod 12 is supported by way of an axial bearing 17 on the bottom 18 of the upright tube 1 where it is releasably secured by a fixing clamp 19.

The ring channel 8 and the sectional housing chambers 11 and 15 are filled with gas under comparatively high pressure and possibly with a given quantity of oil. In the vicinity of the guide and seal unit 13, the second sectional housing chamber 15 is permanently connected to the ring channel 8 by means of an overflow channel 20. When the valve 9 is opened by the operating pin 10 being pressed, then, given sufficient relief of the housing 6, the piston rod is pushed out, i.e. the housing 6 is pushed upwards out of the upright tube 1. With corresponding load acting on the housing 6, it is pushed downwards into the upright tube 1 and the piston rod 12 is retracted into the housing 6. When the valve 9 is shut off by release of the operating pin 10, then the housing 6, together with the piston rod 12, is locked, as it were, by the pressure that prevails in the housing 6, with a gas filling providing for flexibly resilient locking and a filling predominantly of fluid providing for mostly rigid locking. The entire structure and mode of operation of the gas spring 4—as far as specified hereinbefore—are generally known for example from U.S. Pat. No. 3,656,593. Correspondingly, the basic structure and mode of operation of the chair column is known from the patent DE 19 31 021.

On its outside, the guide bush 2 comprises longitudinal ribs 21, by means of which it supports itself on the inside wall 22 of the upright tube 1 radially of the axis 3. Corresponding longitudinal grooves 23 are formed between the longitudinal ribs 21. The end, inside the upright tube 1, of the guide bush 2 is provided with a locking abutment 24 substantially including a ring 25 and fixing ribs 26 which are formed thereon and inserted into the longitudinal grooves 23, running parallel to the axis 3. By means of these fixing ribs 26, the abutment 24 is tightly mounted on the guide bush 2, in particular non-rotatably. By ultrasonic welding or the like it is joined to the guide bush 2 where it is held by clamping; the guide bush 2 also consists of weldable plastic material. The guide bush 2 itself is press-fitted into the upright tube 1, sufficiently fixed against rotation, possibly by additional securing means.

A locking element 27, substantially in the form of a ring, is mounted on the housing 6 at the end thereof that is turned towards the guide and seal unit 13 and located where the piston rod exits. The guide bush 2, the locking abutment 24 and the locking element 27 constitute a safeguard against rotation. The abutment 24 and the element 27 are each provided with cutouts 28, 29, whereby locking ribs 30, 31 are formed. The cutouts 28, 29 and thus the ribs 30, 31 are such that the locking rib 30 of the abutment 24 engages with the cutout 29 of the element 27 and the rib 31 of the element 27 engages with the cutout 28 of the abutment 24, and that without play. The ribs 30, 31 each have inclined surfaces 32, 33 which are disposed at an angle to the axis 3 in such a way that the cutouts 28, 29 expand towards their respective open side. The inclined surfaces 32 and 33, which are allocated to one another upon engagement of the element 27 with the abutment 24, have the same aperture angle b in relation to a line that is parallel to the axis 3. The peripheral extension of the locking ribs 30, 31 is such that, when the locking element 27 enters into the locking abutment 24, a clearance 36 and 37, respectively, in the direction of the axis 3 remains between the bottom 34 of the cutout 28 of the abutment 24 and the locking rib 31 of the locking element 27, and between the bottom 35 of the cutout 29 of the locking element and the locking rib 30. In this case the inclined surfaces 32, 33 rest tightly on each other, there being no tangential play, i.e. no rotary play, of the locking element 27 in relation to the abutment 24.

Upon completion of the extraction of the housing 6 of the gas spring 4 from the upright tube 1, by corresponding rotation about the axis 3 of the housing 6 of the gas spring 4, or respectively of the seat fixed thereto, in relation to the upright tube 1, the locking element 27 can be moved in relation to the locking abutment 24 into such a position that it engages with the abutment 24 in the way described, thus being non-rotatably joined thereto. In this position, the seat that is fixed to the fastening section 16 cannot rotate any more in relation to the pedestal that is fixed to the upright tube 1.

The aperture angle b is selected such that, with corresponding turning moments acting between the housing 6 and the upright tube 1, the locking element 27 and the locking abutment 24 are forced apart in the direction of the axis 3 by way of the inclined surfaces 32, 33. Dimensioning is effected by way of coordination of the push-out force which exists between the piston rod 12 and the housing 6 in the extracted condition owing to the inner gas pressure, the mean radius r of the inclined surfaces 32, 33, and the turning moment that is considered admissible. Consequently, the safeguard against rotation works by positive fit until the given turning moment is reached. $5° \leqq b \leqq 25°$, and preferably $10° \leqq b \leqq 15°$, applies to the aperture angle b.

What is claimed is:

1. An adjustable-height chair column, comprising an upright tube (1) which has a central longitudinal axis (3);

a gas spring (4) which is disposed in the upright tube (1) coaxially of the central longitudinal axis (3), having a housing (6) which is rotatable and displaceable inside the upright tube (1) in the direction of the central longitudinal axis (3) into an extended position and a piston rod (12) which is fixed in the upright tube (1); and a safeguard against rotation (2, 24, 27) which, in the extended position only, locks the housing (6) and the upright tube (1) against rotation.

2. An adjustable-height chair column according to claim 1, wherein the safeguard against rotation (2, 24, 27) is designed for action by positive fit.

3. An adjustable-height chair column according to claim 1, wherein the safeguard against rotation (2, 24, 27) is designed for release when a given turning moment between the housing (6) and the upright tube (1) is exceeded.

4. An adjustable-height chair column according to claim 1, wherein the safeguard against rotation (2, 24, 27) comprises a locking element (27), which is joined to the housing (6), and a locking abutment (24), which is joined to the upright tube (1).

5. An adjustable-height chair column according to claim 4, wherein at least one of the locking element (27) and the locking abutment (24) comprises at least one cutout (28, 29) and at least one locking rib (30, 31) which is allocated and adapted to the at least one cutout (28, 29).

6. An adjustable-height chair column according to claim 5, wherein the at least one cutout (28, 29) and the at least one locking rib (30, 31) have matching inclined surfaces (32, 33) of an aperture angle b in relation to a line that is parallel to the central longitudinal axis (3).

7. An adjustable-height chair column according to claim 6, wherein the locking element (27) and the locking abutment have a plurality of said cutouts and said locking ribs, each said cutouts (28, 29) and each said locking ribs (30, 31) respectively matching inclined surfaces (32, 33).

8. An adjustable-height chair column according to claim 6, wherein $5° \leqq b \leqq 25°$ applies to the aperture angle b.

9. An adjustable-height chair column according to claim 8, wherein $10° \leqq b \leqq 15°$ applies to the aperture angle b.

10. An adjustable-height chair column according to claim 7, wherein all the inclined surfaces (32, 33) are close to each other in the extended position.

11. An adjustable-height chair column according to claim 10, wherein, in the extended position, a clearance (36, 37) exists between the bottom (34, 35) of a cutout (28, 29) and the locking rib (30, 31) that engages with the cutout (28, 29).

12. An adjustable-height chair column according to claim 5, wherein solely one adapted cutout (28, 29) is allocated to each locking rib (30, 31).

* * * * *